US006153124A

United States Patent [19]

Hung

[11] Patent Number: 6,153,124

[45] Date of Patent: Nov. 28, 2000

[54] ELECTRICALLY-CONDUCTIVE FABRIC

[76] Inventor: Chu-An Hung, No. 246, Yung Chun East 2nd Rd., Nan Tun Zone, Taichung, Taiwan

[21] Appl. No.: 09/533,654

[22] Filed: Mar. 23, 2000

[51] Int. Cl.[7] ..... H01B 1/02; H01B 1/22; D06M 11/83

[52] U.S. Cl. ..... 252/513; 442/110; 428/300.1

[58] Field of Search ..... 252/8.61, 8.84, 252/513; 442/60, 110; 428/300.1

[56] References Cited

U.S. PATENT DOCUMENTS 3,722,440 3/1973 Igarashi et al. ..... 112/262
4,926,570 5/1990 Fohst ..... 36/43
5,102,727 4/1992 Pittman et al. ..... 428/259
5,593,618 1/1997 Okoniewski et al. ..... 252/512

*Primary Examiner*—Mark Kopec
*Attorney, Agent, or Firm*—Browdy and Neimark

[57] ABSTRACT

A fabric is conductive to electricity and is made of 70–98% by weight of a thermoplastic fiber material and 2–30% by weight of a conductor yarn. The conductor yarn is made of 5–30% by weight of a galvanized iron fiber and 70–95% by weight of a polyester fiber. The fabric is made by knitting. The conductivity of the fabric is directly proportional to the concentration of the conductor yarn.

8 Claims, No Drawings

ELECTRICALLY-CONDUCTIVE FABRIC

FIELD OF THE INVENTION

The present invention relates generally to a fabric, and more particularly to a fabric which is conductive to electricity.

BACKGROUND OF THE INVENTION

A prior art electrically-conductive fabric is made of a fabric which is coated on the outer surface thereof with a short fiber layer made of a conductive metal, such as copper, silver, etc. Such a fabric as described above is not suitable for the industrial use in light of its stiffness.

Another prior art electrically-conductive fabric is made of thermoplastic fibers, and carbon fibers which are provided with a coating of metal, such as copper, silver, or the like. This prior art fabric is not cost-effective in view of the high cost of carbon fibers, as well as the high cost of labor for coating the metal layer of the carbon fibers. In addition, the coated carbon fibers become heavy and stiff. Moreover, this prior art fabric can be made by weaving only, thereby undermining the matted properties of the fabric, such as the appearance or feel of the fabric surface, tension guality of the fabric, expansibility of the fabric, etc.

SUMMARY OF THE INVENTION

The primary objective of the present invention is to provide an electrically-conductive fabric which is cost-effective and is made by knitting.

In keeping with the principle of the present invention, the foregoing objective of the present invention is attained by an electrically-conductive fabric which is made of 70–98% by weight of a thermoplastic fiber material, such as polyester, nylon, polypropylene, etc., and 2–30% by weight of a conductor yarn of steel fiber polyester. The fabric of the present invention is made by knitting and has a resistance value ranging between 10° Ω/SQ and $10^{12}$ Ω/SQ. The steel fiber polyester is made of 5–30% by weight of the galvanized iron fiber and 70–95% by weight of the polyester fiber.

The features and the advantages of the present invention with be more readily understood upon a thoughtful deliberation of the following detailed description of two embodiments of the present invention.

DETAILED DESCRIPTION OF THE INVENTION

An electrically-conductive fabric embodied in the present invention is made of a polyester fiber and a conductor yarn by knitting. The weight percentage of the polyester fiber ranges between 70% and 98%, preferably between 75% and 85%, with the optimal weight percentage being 80%. The weight percentage of the conductor yarn ranges between 2% and 30%, preferably between 5% and 25%, with the optimal weight percentage being 20%.

The conductor yarn is made of the steel fiber polyester, which contains 7–10% by weight of the galvanized iron fiber and 90–93% by weight of polyester fiber.

The electrically-conductive fabric of the present invention has a resistance value ranging between 10° Ω/SQ and $10^{12}$ Ω/SQ. The fabric of the first preferred embodiment of the present invention has a resistance value of $10^5$ Ω/SQ, and a conductivity coefficient of 50V.

An electrically-conductive fabric of a second preferred embodiment of the present invention is made of polypropylene and conductor yarn by knitting. The weight percentage of the polypropylene ranges between 70% and 98%, preferably between 80% and 90%, with the optimal weight percentage of the conductor yarn ranges between 2% and 30%, preferably between 10% and 20%, with the optimal weight percentage being 13%. The conductor yarn is made of steel fiber polyester which contains 18–22% by weight of the galvanized iron fiber and 78–82% by weight of the polyester fiber.

The fabric of the second preferred embodiment of the present invention has a resistance value of $10^5$ Ω/SQ, and a conductivity coefficient of 50V.

The electrically-conductive fabric of the present invention has advantages over the electrically-conductive fabric of the prior art. In the first place, the fabric of the present invention is cost-effective and competitive in the market place in terms of price and quality. The fabric of the present invention is relatively pliable and suitable for use in furniture, garment, footwear, automotive accessories, etc. In addition, the fabric of the present invention is static-free and does not collect dust easily.

The conductivity of the fabric of the present invention is directly proportional to the weight percentage of the conductor yarn. However, an increase in concentration of the conductor yarn results in a corresponding increase in material cost of the fabric of the present invention.

What is claimed is:

1. A fabric having a conductivity coefficient and a resistance value, said fabric being made of 70–98% by weight of a thermoplastic fiber material and 2–30% by weight of a conductor yarn by knitting whereby said conductor yarn is made of 5–30% by weight of a galvanized iron fiber and 70–95% by weight of a polyester fiber.

2. The fabric as defined in claim 1, wherein said thermoplastic fiber material is polyester, nylon, or polypropylene.

3. The fabric as defined in claim 2, wherein the weight percentage of said polyester ranges between 75% and 85%; and wherein the weight percentage of said conductor yarn ranges between 15% and 25% whereby said conductor yarn is made of 5–15% by weight of said galvanized iron fiber and 85–95% by weight of said polyester fiber.

4. The fabric as defined in claim 2, wherein the weight percentage of said polypropylene ranges between 70% and 98%; and wherein the weight percentage of said conductor yarn ranges between 10% and 20% whereby said conductor yarn is made of 15–25% by weight of said galvanized iron fiber and 75–85% by weight of said polyester fiber.

5. The fabric as defined in claim 1, wherein the conductivity coefficient of said fabric is about 50V.

6. The fabric as defined in claim 1, wherein the resistance value of said fabric ranges between 10° Ω/SQ and $10^{12}$ Ω/SQ.

7. The fabric as defined in claim 3, wherein the resistance value of said fabric is about $10^5$ Ω/SQ.

8. The fabric as defined in claim 4, Wherein the resistance value of said fabric is about $10^5$ Ω/SQ.

* * * * *